US007343729B2

(12) United States Patent
Rosenwasser et al.

(10) Patent No.: US 7,343,729 B2
(45) Date of Patent: Mar. 18, 2008

(54) SIMULATED CHAINS WITH FLEXIBLE SECTIONS

(75) Inventors: David Rosenwasser, Norwood, NJ (US); Avraham Rosenwasser, Norwood, NJ (US)

(73) Assignee: Avraham Rozenvasser, Hoboken, NJ (US)

( * ) Notice: Subject to any disclaimer, the term of this patent is extended or adjusted under 35 U.S.C. 154(b) by 313 days.

(21) Appl. No.: 11/197,739

(22) Filed: Aug. 4, 2005

(65) Prior Publication Data

US 2006/0032209 A1 Feb. 16, 2006

Related U.S. Application Data

(60) Provisional application No. 60/599,078, filed on Aug. 5, 2004.

(51) Int. Cl.
*B21L 11/00* (2006.01)

(52) U.S. Cl. ..... 59/35.1; 59/80; 59/84

(58) Field of Classification Search ..... 59/78, 59/80, 82, 84, 79.1
See application file for complete search history.

(56) References Cited

U.S. PATENT DOCUMENTS

| | | | | | |
|---|---|---|---|---|---|
| 2,848,865 | A | * | 8/1958 | Napoli et al. | 59/80 |
| 2,998,697 | A | * | 9/1961 | Augenstein | 59/80 |
| 3,007,301 | A | * | 11/1961 | Sand | 59/80 |
| 5,301,498 | A | * | 4/1994 | Chia et al. | 59/80 |
| 5,542,244 | A | * | 8/1996 | Chia et al. | 59/35.1 |
| 5,682,736 | A | * | 11/1997 | Chia et al. | 59/35.1 |

* cited by examiner

*Primary Examiner*—David B Jones
(74) *Attorney, Agent, or Firm*—Katten Muchin Rosenman LLP

(57) ABSTRACT

Methods and apparatus are provided for cost effectively forming jewelry chains that simulate the appearance of particular types of conventional chain using substantially rigid sections. The rigid sections are interconnected by conventionally formed flexible sections of conventional chain. The result is that the overall jewelry chain appears as an integral and homogenous chain having a consistent aesthetic appearance. The resulting chains also provide flexibility through the use of the one or more flexible sections of conventionally formed chains. The rigid sections may be formed by cutting lengths of material upon which chain simulation patterns have been formed.

22 Claims, 11 Drawing Sheets

SIMULATED CHAINS WITH FLEXIBLE SECTIONS

CROSS-REFERENCE TO RELATED APPLICATIONS

The present invention claims priority to U.S. Provisional Patent Application No. 60/599,078 entitled "SIMULATED CHAINS WITH FLEXABLE SECTIONS" filed Aug. 5, 2004, which is hereby incorporated herein for all purposes.

BACKGROUND OF THE INVENTION

1. Field of Invention

The present invention relates generally to articles of jewelry. More specifically, the present invention relates to those articles of jewelry that require flexibility such as chains, bracelets, or the like. Such articles of jewelry are typically made of precious material such as gold, silver, platinum, and the like.

2. Discussion of Prior Art

Typical articles of jewelry such as bracelets, chains or the like require some degree of flexibility in order to permit them to be encircled or wrapped around a portion of the body such as the wrist or the neck. Accordingly, many chains are formed inherently in a manner to provide such flexibility. For example, rope chains are formed by interconnecting individual links, which are interwoven into a double helix configuration providing flexibility by the movement of the links with respect to each other. A typical method of forming such jewelry rope chains is described in U.S. Pat. No. 4,651,517. Essentially, a weaving type operation is utilized where one link is intertwined to the next link, into a double helix configuration. The links are then held together with strands of wire placed within the valleys forming the double helix configuration. The links are then soldered in such a manner that they will be self-retained without the wires and at the same time provide a degree of flexibility. The wires are thereafter removed and the chain remains in such a rope-like configuration.

Other types of chains also exist which inherently provide flexibility in their structure or configuration. By way of example, there is a chain known as the Omega chain. Such Omega chain has an internal flexible wire mesh that is initially formed in a woven configuration. Independent link segments are then placed over the woven wire mesh. The link segments are arranged in an end-to-end abutting relationship. The links are pressed onto the mesh, but provide flexibility between adjacent links.

Another type of flexible chain is known as the San Marco chain. This chain is formed by partial links that are essentially half of an annular configuration, each link forming a semicircle when two annular halves are joined. The links are connected by coupling the sides of opposite ends of two adjacent semicircular sections using internal hinge pins. In other words, a hinge pin connects an annular half of a first link to the annular half of the second adjacent link. The first link is then closed by mating a second annular half to the existing annular half of the first link (forming the complete semicircle). This process is continued so that these semi-annular links are hinged one to another to permit flexible movement between them.

Other types of flexible linking arrangements are available in other types of chains. Generally, all of them have typically links of one shape or another that are interconnected by one means or another to provide such adjacent flexibility.

While such assemblies of chains are well known, the cost of producing such chains is quite high because of the necessity of intensive labor activities that are involved in the formation and the interconnecting of such links to form such flexible chains. Accordingly, a need exists for methods and apparatus for forming decorative chains that are less labor intensive to manufacture but at the same time preserve both the appearance and flexibility of jewelry made from conventional chain assemblies.

SUMMARY OF THE INVENTION

The present invention provides methods and apparatus for cost effectively forming jewelry chains that simulate the appearance of particular types of conventional chain using substantially rigid sections. The rigid sections are interconnected by conventionally formed flexible sections of conventional chain. The result is that the overall jewelry chain appears as an integral and homogenous chain having a consistent aesthetic appearance. The resulting chains also provide flexibility through the use of the one or more flexible sections of conventionally formed chains. However, the cost, and in many cases the amount of precious metal required, is substantially lower than conventional chains having the same appearance. Other features and aspects of the present invention will become more fully apparent from the following detailed description of exemplary embodiments, the appended claims, and the accompanying drawings.

DETAILED DESCRIPTION OF THE INVENTION

Figure 1:
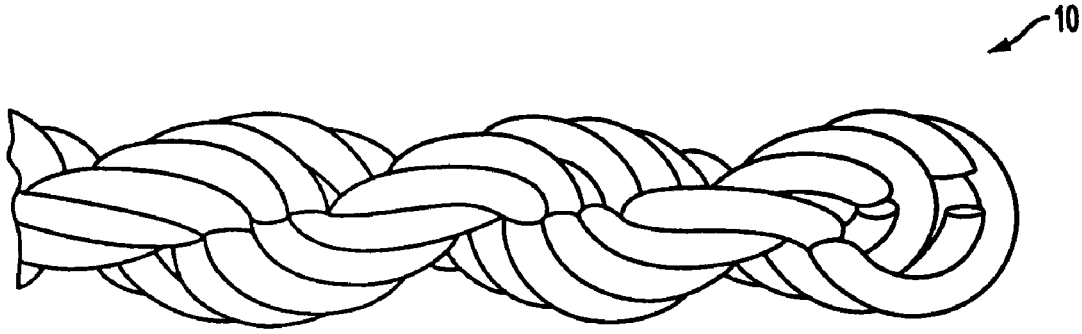
FIG. 1 illustrates a top view of a rope chain.

While the present invention is illustrated and described in a preferred embodiment, covered devices may be produced in many different configurations, forms and materials using many different methods. There is depicted in the drawings, and will herein be described in detail, a preferred embodiment of the invention, with the understanding that the present disclosure is to be considered as an exemplification of the principles of the invention and the associated functional specifications for its construction and is not intended to limit the intervention to the embodiment illustrated. Those skilled in the art will envision many other possible variations within the scope of the present invention.

Reference will now be made in detail to embodiments of the invention that are illustrated in the accompanying drawings. Wherever possible, same or similar reference numerals are used in the drawings and the description to refer to the same or like parts or steps. The drawings are in simplified form and are not to precise scale. For purposes of convenience and clarity only, directional terms, such as upper, lower, top, bottom, left, right, up, down, over, above, below, beneath, rear, and front may be used with respect to the drawings. These and similar directional terms should not be construed to limit the scope of the invention in any manner. The words "connect," "couple," and similar terms with their inflectional morphemes do not necessarily denote direct and immediate connections, but also include connections through mediate elements or devices. Furthermore, such terms as "conventional chain," "chain jewelry," "actual chain," "authentic chain," and "standard chain" are used interchangeably. The following detailed description is of the best mode or modes of the invention presently contemplated. As indicated above, such description is not intended to be understood in a limiting sense, but to be an example of the invention presented solely for illustration thereof, and by reference to which in connection with the following description and the accompanying drawings one skilled in the art may be advised of the advantages and construction of the invention.

Figure 2:
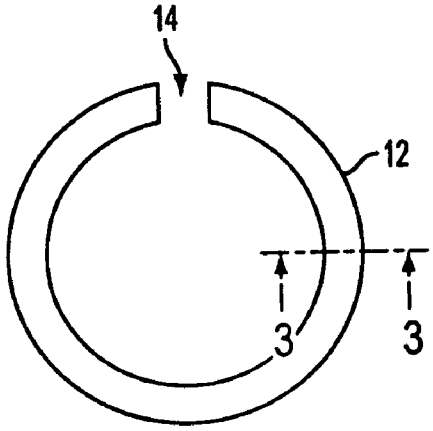
FIG. 2 is a front view of a link used to form the rope chain of FIG. 1.

FIG. 1 illustrates a perspective view of a jewelry rope chain 10. Typically, such rope chain is formed by individual links. An annular link is shown in FIG. 2 by way of example. Such link 12 is shown to be substantially circular and includes a gap 14 around its periphery. The cross-sectional view of such link is shown to be circular in FIG. 3.

Figure 3:
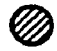
FIG. 3 is a cross sectional view taken along line 3-3 of FIG. 2.

It should be appreciated that links of other shapes could be utilized just as well. As is well know, the links can have shapes including squares, triangles, rhombuses, ellipses, etc. Furthermore, wire used for such links can also have any cross-sectional shape including the circular shape as actually shown, square, triangular, oval or any other shape. Furthermore, while a solid wire is shown in FIG. 3, it should be appreciated that hollow wire can also be utilized and such hollow wire can either include a seam along the inner periphery or it can be seamless.

Conventionally, such links, whatever their shape, are interconnected to a form a double helix configuration. One method of interconnecting such links is as shown in U.S. Pat. No. 4,651,517, which is hereby incorporated herein by reference. These links are interwoven with the gaps alternating up and down with specific ratios. The ratios shown in the '517 patent are the well know 3:1 ratio but other ratios, such as 5:1, etc., may also be employed. Furthermore, even number ratios can likewise be used as described in U.S. Pat. No. 4,934,135, which is hereby incorporated herein by reference. In the case of an even number ratio, links may have their gaps oriented in the same direction. Other assemblies of such links to form a rope chain in other configurations and by any other methods of weaving such assemblages are likewise included within the scope of the present invention.

When intertwining the links in accordance with the aforementioned well-know principles, the links are held together by temporary strands of wire. The links are then soldered together and the strands of wire removed. Thereafter the elongated rope chain can be cut into whatever length desired and made into whatever piece of jewelry required such as bracelets, necklaces, etc. Such rope chain will exhibit a flexibility so that it can be bent around the wrist or the neck, or be twisted into other forms for necklaces, earrings, and the like.

Figure 4:
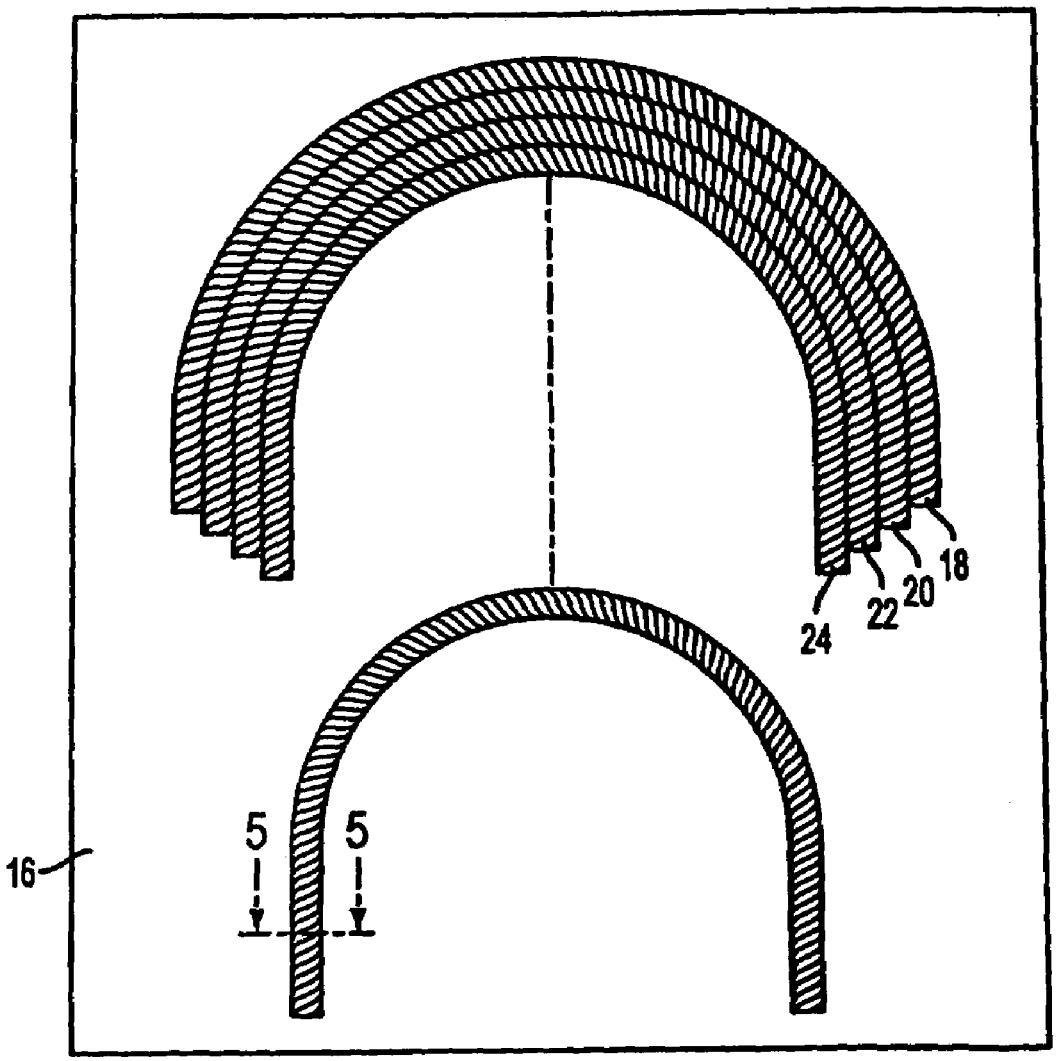
FIG. 4 is a sheet of material on which simulated sections of rope chain have been formed.

The present invention contemplates forming simulated sections which provide the appearance of a rope chain. By way of example, there is shown a flat piece of precious material such as gold, silver, platinum or the like in FIG. 4. Stamped from such sheet of precious material are a series of arcuate sections 18, 20, 22, 24, etc. These arcuate sections are nested one adjacent the other to best utilize the material efficiently. Each of these arcuate sections may be die-pressed in three dimensions to provide the appearance of a rope chain configuration.

Figure 5:
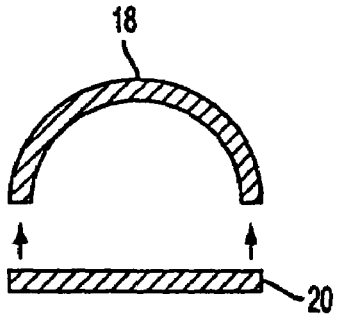
FIG. 5 is cross sectional view of an upper section having simulated rope chain formed on it together with a flat-bottom lower section.
Figure 6:
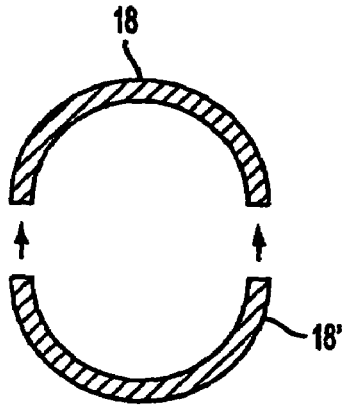
FIG. 6 shows the interconnection of two stamped simulated rope chain sections.

After the arcuate sections 18, 20, 22, 24, etc. are individually stamped and cut, they may then be assembled with a bottom underpiece. As shown on FIG. 5, the top section 18, which is shown in cross-section taken through the die portion 18 shown in FIG. 4, may then connected with a flat bottom 20. Alternately, as shown in FIG. 6, a bottom portion of substantially similar die-cut shape 18 can be connected whereby the entire cross-section of the simulated rope chain section will appear both on the top and bottom as a rope chain.

It should be appreciated that instead of using a die, these sections can be formed by drawing, pressing, casting, or any other method to aesthetically form the configuration of a rope chain onto the material.

Figure 7:
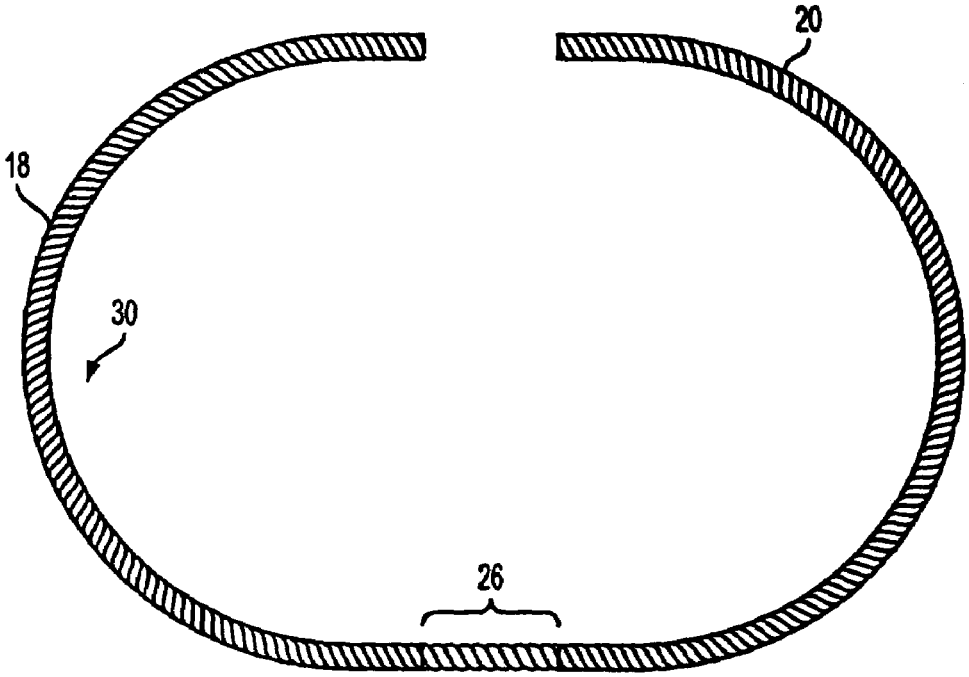
FIG. 7 shows an overall article of jewelry showing the interconnection of rigid simulated sections with actual sections.

The simulated sections 18, 20 are substantially rigid. As shown in FIG. 7, these sections 18, 20 may be interconnected by a section 26 of standard rope chain flexibly formed by interwoven links. The overall appearance of the jewelry (e.g., necklace) once connected is substantially uniform since the sections 18, 20 have been formed to make them appear as a conventional rope chain. Note that the section 26 is actual rope chain. The simulated sections 18, 20 and the actual section 26 may be interconnected through links, or any other interconnecting method. However, because of the presence of the flexible actual section 26, the entire necklace 30 becomes functionally flexible even with the presence of the two simulated sections 18, 20, which are substantially rigid. The jewelry can then be placed around, for example, the neck.

While the chain on FIG. 7 has two rigid sections interconnected by one flexible section, other combinations can also be utilized. For example, shorter rigid sections can be used, for example, half-inch sections, inch sections, etc. The rigid sections can then be interconnected by flexible standard rope chain connections. These compound sections can then be used to form any type of article of jewelry such as a bracelet, a necklace, earrings, etc.

It should be appreciated that in using the rigid sections, a smaller amount of material (e.g., gold) is needed than to form standard intertwined links conventionally used to form rope chain. Furthermore, labor cost is dramatically reduced by using the simulated sections. The labor is reduced to interconnecting the rigid and flexible sections as compared to interweaving the entire length of the rope chain as required when manufacturing conventional types of rope chains.

Figure 8:
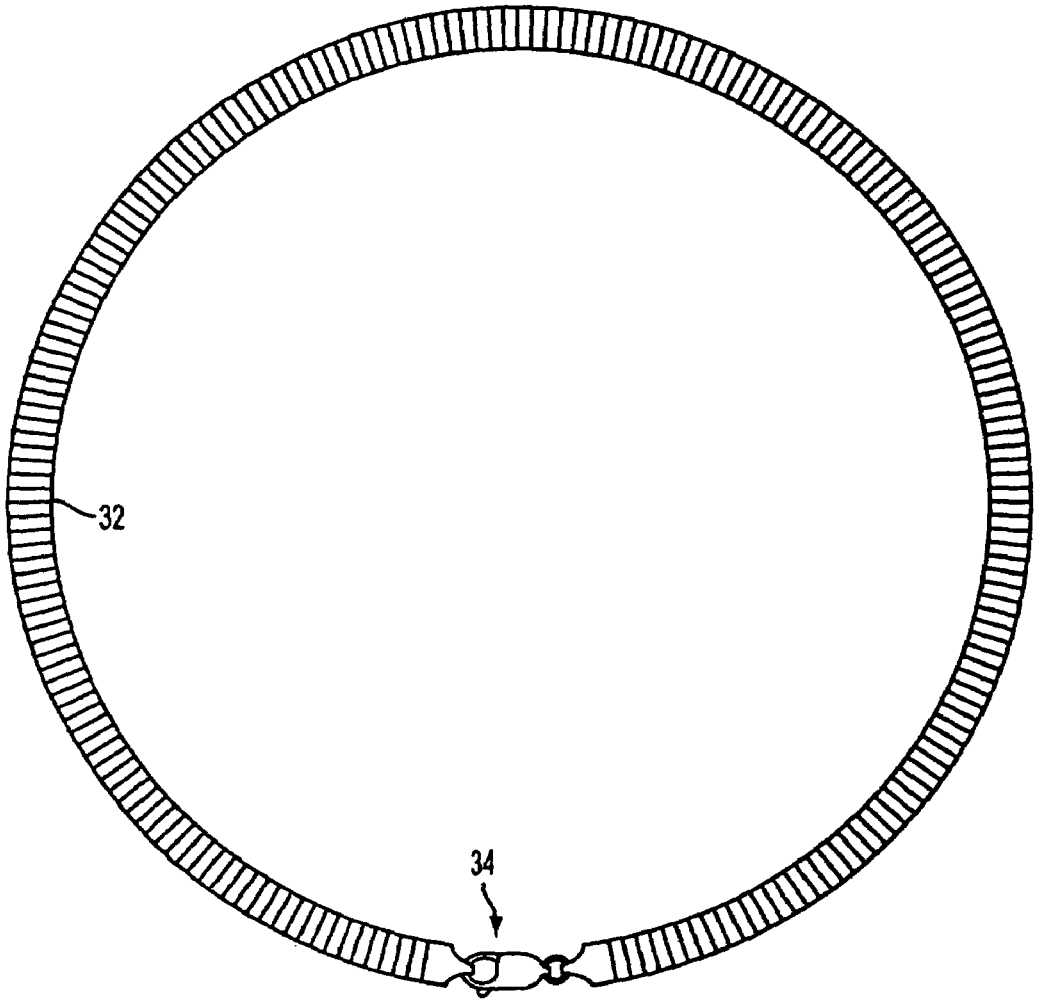
FIG. 8 is a top view of an Omega chain.

Although the description thus far has been with respect to rope chains, it should be appreciated that the same inventive concepts may be applied with respect to other types of chains. By way of example, there is shown in FIG. 8 what is commonly known as an Omega chain. Such chain 32 is shown as a necklace interconnected by a clasp 34.

Figure 9:
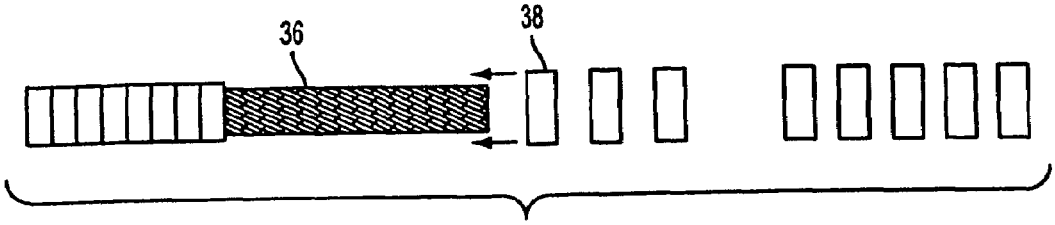
FIG. 9 shows the formation of an Omega chain with links and a mesh portion.
Figure 10:
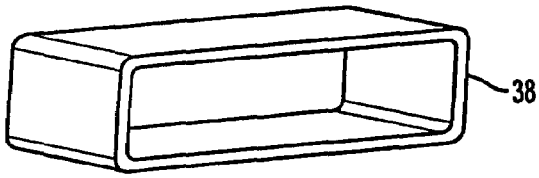
FIG. 10 shows a perspective view of a link used in the Omega chain.
Figure 11:
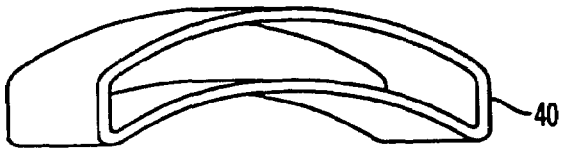
FIG. 11 shows a perspective view of another type of link used in an Omega chain.
Figure 12:
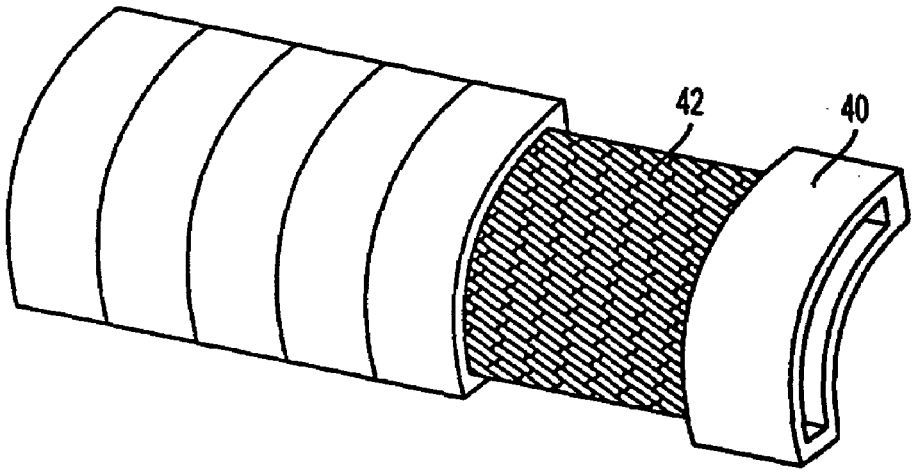
FIG. 12 shows the assembly of the links of FIG. 11 onto a mesh to form another type of Omega chain.

Omega-type chain is conventionally formed by initially providing a woven mesh plate 36, as shown in FIG. 9. Individual links 38 as shown in FIG. 10 are individually formed and then slid onto the mesh 36 as shown in FIG. 9. These links are then pressed together. Instead of the rectangular shape shown in FIG. 10, other shapes of links, such as, for example, the arcuate shape 40 shown in FIG. 11 may also be used. These links again are slid onto the mesh, as shown in FIG. 12. In the example of FIG. 12, the mesh 42 may be bent to accommodate the links 40.

Figure 13:
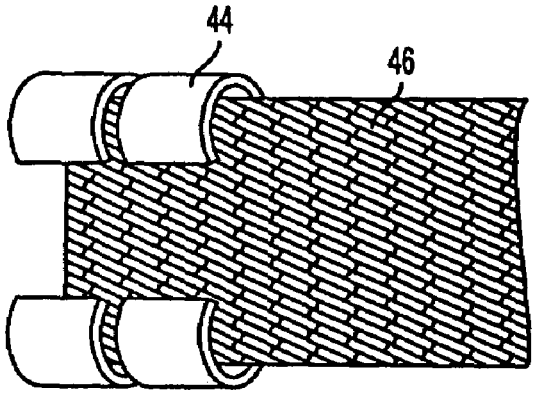
FIG. 13 is an underside view of an Agrafatto type Omega chain.

A variation of such Omega chain is shown in FIG. 13. In the example of FIG. 13, the links 44 are bent over the mesh 46 and grasp onto the mesh 46. As a result, the underside of the chain will appear as shown on FIG. 14 where the inside of the chain 48 is shown. This type of Omega chain is generally know as Agrafatto.

Because there are individual links that are capable of moving one against each other and held in place by means of the mesh 36, 42, 46, the entire chain is somewhat flexible. However, it is quite costly since initially the mesh must be formed and thereafter the individual links must be formed and assembled. The amount of material used is expensive and the cost of labor is high.

Figure 15:
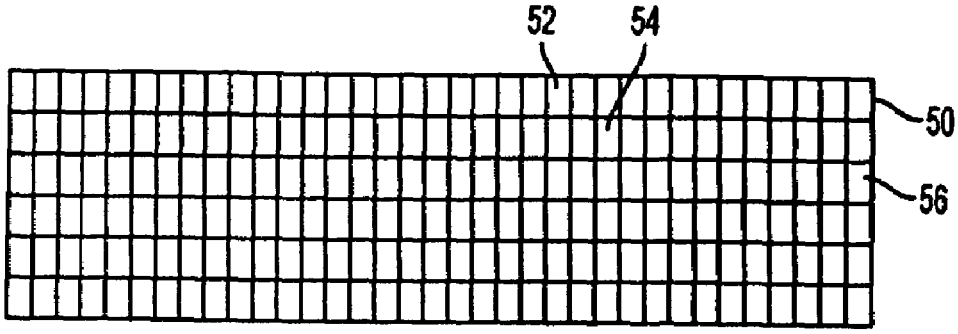
FIG. 15 is a sheet of material on which Omega links have been stamped.
Figure 16:
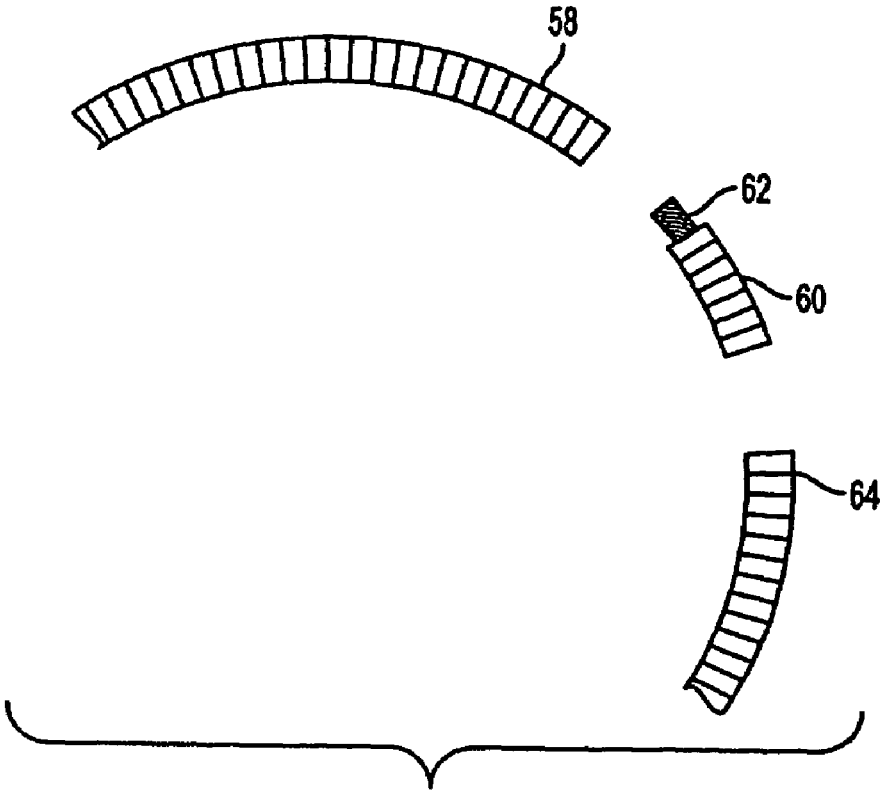
FIG. 16 shows the formation of an Omega chain in accordance with the present invention.

A similar-looking chain can be made in accordance with the present invention. Specifically, the sections of the Omega-looking chains can initially be formed by casting, dieing, extruding, pressing, or any other well-known method to imprint onto a sheet of precious metal, the aesthetic appearance of a section of Omega chain. By way of example, as shown on FIG. 15, there is shown a sheet of precious metal 50 such as gold, silver, platinum, or the like. The sheet has been die-pressed in a pattern to form the appearance of Omega links. The patterns are formed in elongated strips 52, 54, 56, etc. The patterned strips may then separated and cut into lengths as desired. As shown in FIG. 16, an elongated strip 52 (FIG. 15) can then be curved into an arcuate section 58. The arcuate section 58 is then interconnected to a small section of conventionally formed Omega chain 60. One way of interconnecting the sections would be to insert the mesh 62 into the end portion of the rigid arcuate section 58. Further sections may then be added including rigid sections 64, and other sections of rigid and regular flexible Omega chain interspersed as desired.

It should be appreciated that the length of the rigid simulated sections may be made longer or shorter as needed depending upon the article of jewelry being manufactured. Furthermore other means of interconnection may also be utilized. The resulting article of jewelry therefore has flexibility due to the presence of the actual Omega chain sections. However, because of the simulated rigid sections, the cost will be substantially reduced. However, the overall appearance will be that of a standard Omega chain.

Figure 14:
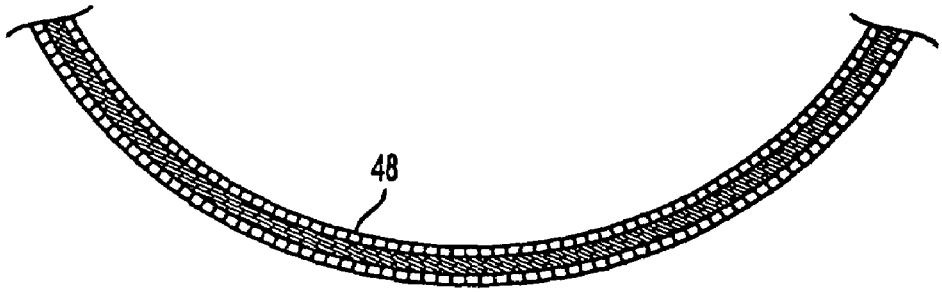
FIG. 14 is the underside of the chain formed in FIG. 13.

Likewise, the appearance of the chain can be made into that of the Agrafatto version as shown on FIGS. 13 and 14, by providing a patterned (e.g., stamped, die-cut, or cast) portion that appears as an Agrafatto section and interconnecting it with actual Agrafatto sections.

Figure 17:
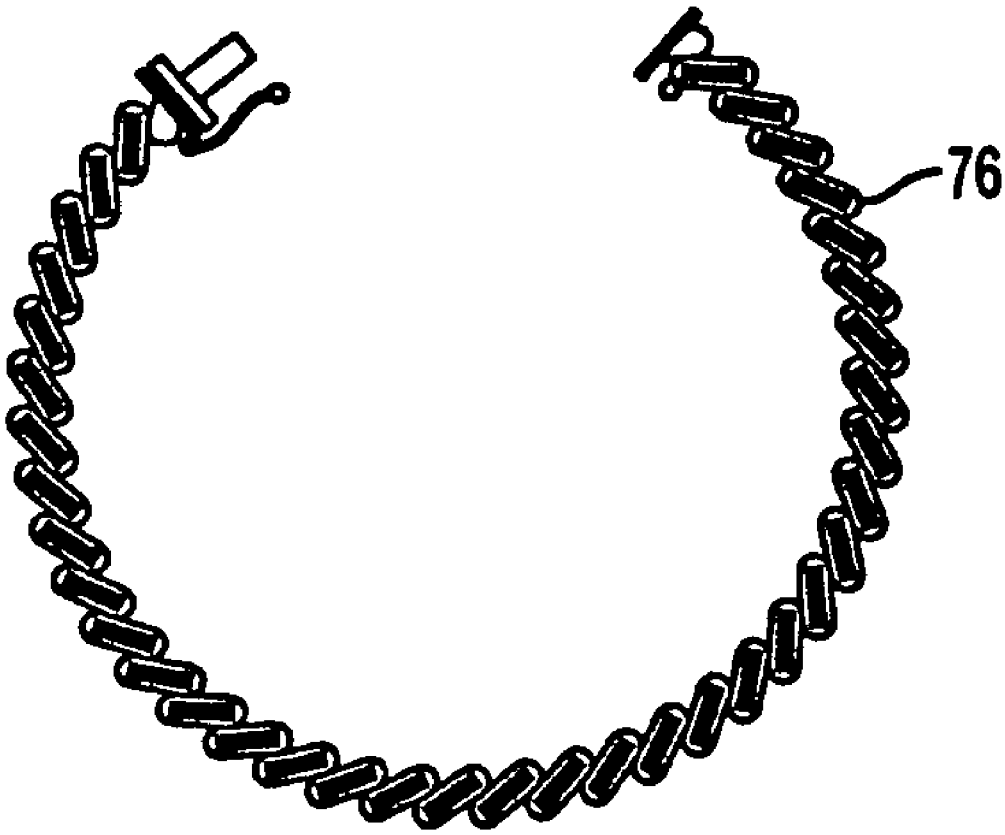
FIG. 17 shows the top view of a San Marco chain.

Another type of chain that is suitable to be simulated by the present invention is known as the San Marco chain. Such chain is depicted in FIG. 17.

Figure 18:
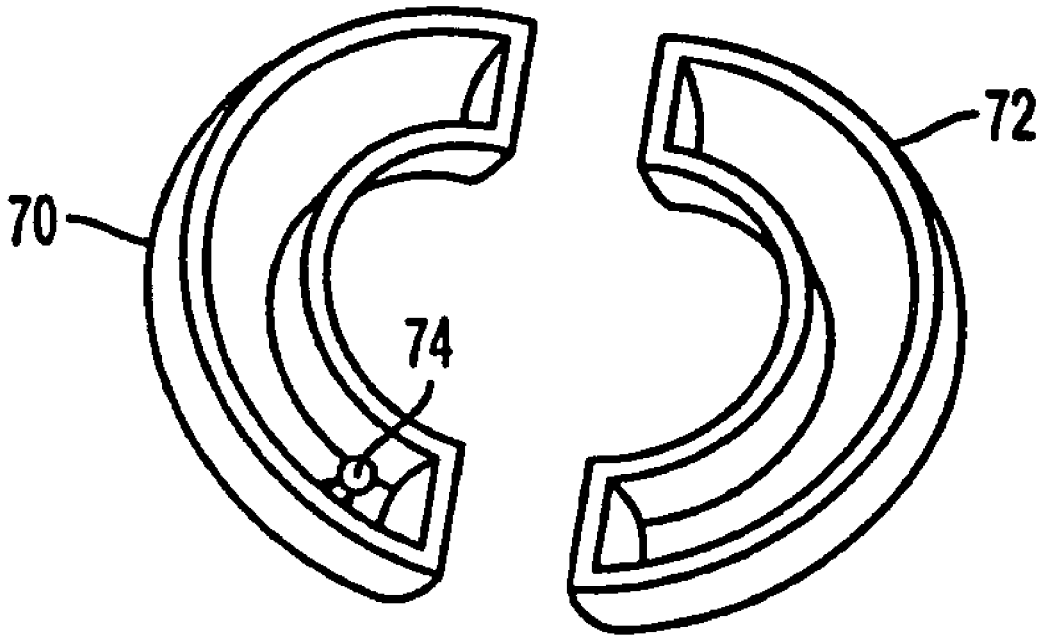
FIG. 18 shows a perspective view of two halves of a link used in the San Marco chain.

The San Marco type chain is typically made up of individual links. Conventionally, each link has two semi-annular sections 70, 72 as shown on FIG. 18. A hinge pin, 74 is inserted through the outer wall of one semi-annular link section. A head is placed on it so it is trapped within this link. The two sections 70 and 72 are then joined together by soldering or any other means. The other end of the pin 74 is then inserted through the outer wall of the next semi-annular link section (not shown). A head is formed thereon to retain the next link in place and the next link is soldered together. This continues with one link being hinged to the next link. The resulting chain 76, shown in FIG. 17, is a flexible type of chain.

Figure 19:
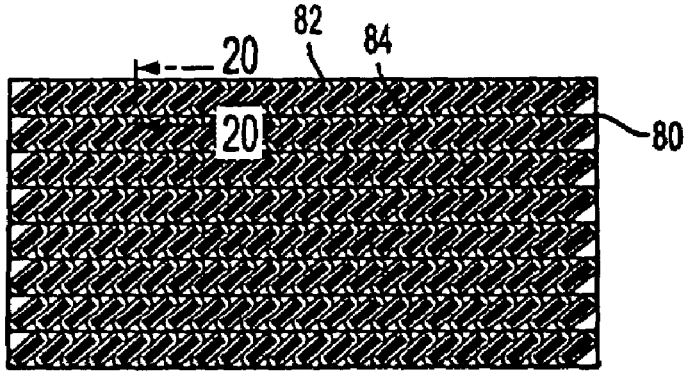
FIG. 19 shows a sheet of material on which is stamped simulated sections of San Marco chain.

In accordance with the present invention, simulated portions representing the appearance of the San Marco type chain may be formed from a sheet of precious material. For example, as shown in FIG. 19, there is provided a sheet of material 80. On the sheet are formed strips of simulated San Marco chain portions. Each of these strips 82, 84, etc. can be separated to form elongated sections having the San Marco appearance.

Figure 20:
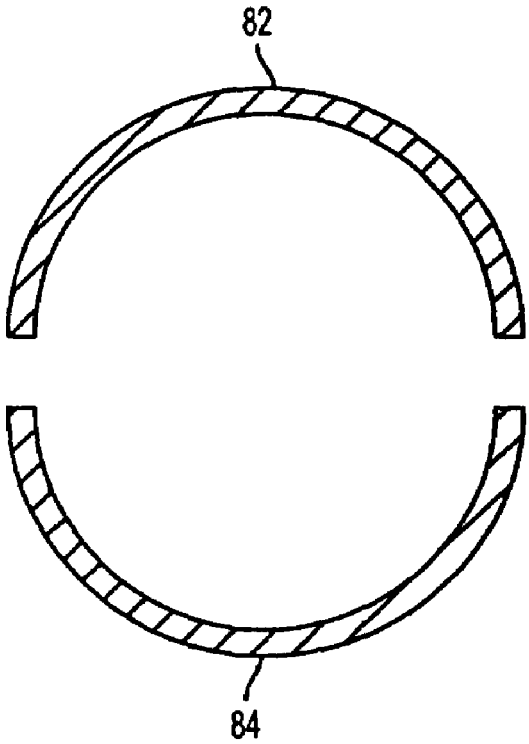
FIG. 20 shows the combination of two strips of simulated San Marco chain in accordance with the present invention.

Each of the strips 82 can be joined longitudinally with another matching strip 84, as shown in cross-section in FIG. 20. The joined strips 82, 84 have the overall San Marco appearance both on the top and bottom of the simulated section. Alternatively, a flat strip (not shown) may be used in place of a matching strip 84, so that only the normally visible (e.g., when worn as jewelry) portion of the chain has the San Marco appearance.

Figure 21:
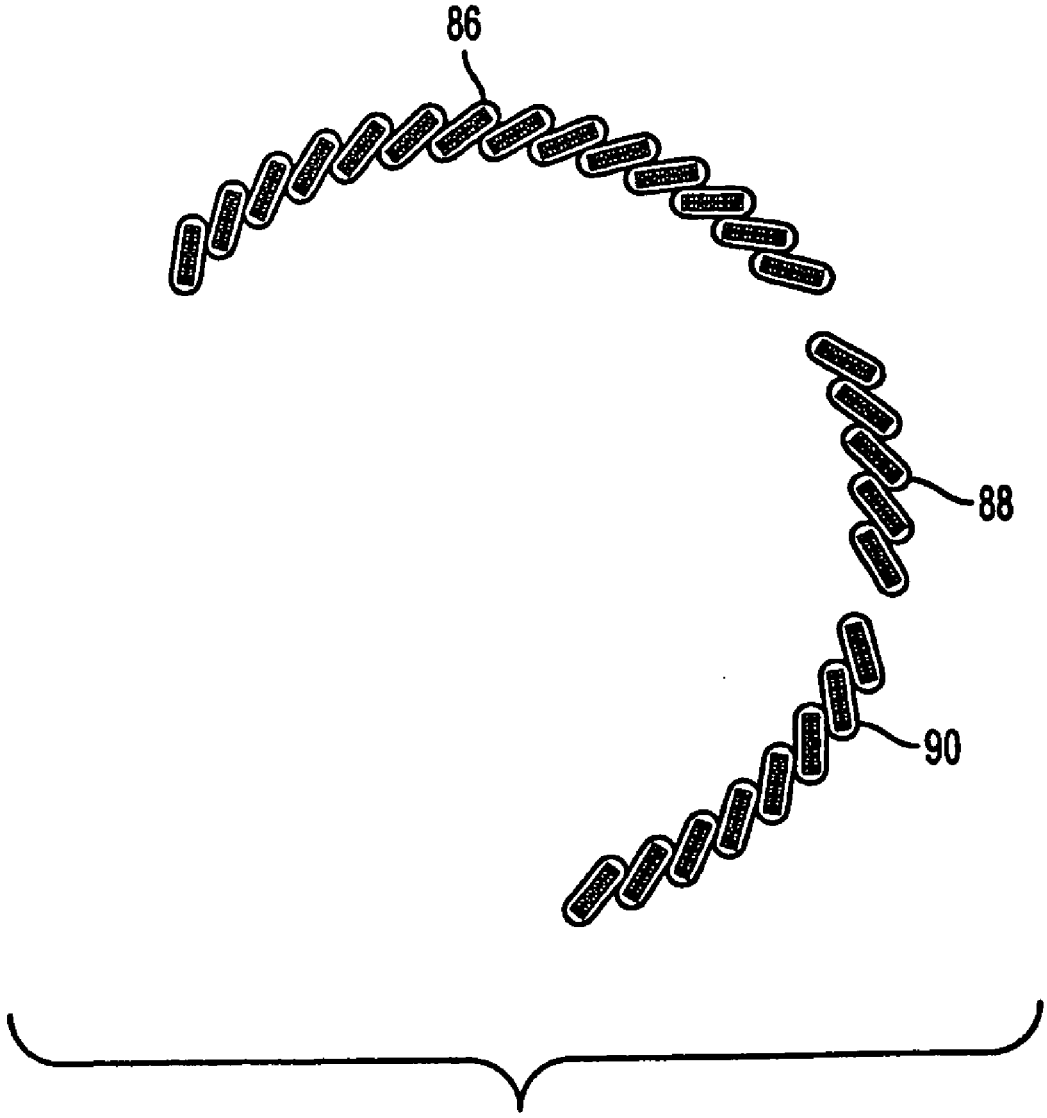
FIG. 21 shows the formation of a San Marco chain in accordance with the present invention.

Thereafter, individual combined parts 82, 84 can then be bent into an arcuate section, 86, as shown in FIG. 21. Such combined arcuate section 86 can then be interconnected to an actual San Marco section 88. Further rigid (simulated) and flexible (actual) San Marco sections 90, etc. can thereafter be linked.

In this manner the overall article of jewelry provides the appearance of a San Marco chain. Flexibility is provided by the one or more interconnected actual San Marco sections 88. In other words, the actual San Marco sections 88 are interconnected between rigid sections which have been formed to simulate the appearance of the San Marco chain. The overall appearance will be that of a San Marco chain. However, the cost will be substantially less while flexibility is retained.

CONCLUSION

Methods and products have been shown in the above embodiments for producing articles of jewelry. The articles can be a bracelet, chain, earring, or the like. Typically, such articles of jewelry are made by interconnecting links in a particular manner. Such interconnected links provide flexibility to the particular article of jewelry so it can be wrapped around a wrist or neck or the like. The approach of the present invention includes forming sections having the appearance of the actual chain. These simulated sections can be formed by stamping, casting, extruding, die-cutting, or the like, a pattern into malleable material (e.g., gold, silver, etc.). The sections are substantially rigid. However, by interconnecting such simulated sections with conventional interwoven link sections, the overall article of jewelry will have the flexibility to be used as a chain, bracelet, or the like. The cost of forming the rigid simulated sections is substantially less in that less gold or precious material is used and substantially less labor is required for manufacture. However, the overall appearance of the chain remains the same as a conventional chain and the article of jewelry of the present invention retains flexibility.

The inventive chain finds particular use in simulating such well-known chains as rope-type chains, Omega-type chains (both of the regular and Agrafatto type), San Marco-type chains and others.

Further, while the present invention has been described at some length and with some particularity with respect to the several described embodiments, it is not intended that it should be limited to any such particulars or embodiments or any particular embodiment, but it is to be construed with references to the appended claims so as to provide the broadest possible interpretation of such claims in view of the prior art and, therefore, to effectively encompass the intended scope of the invention. Furthermore, the foregoing describes the invention in terms of embodiments foreseen by the inventor for which an enabling description was available, notwithstanding that insubstantial modifications of the invention, not presently foreseen, may nonetheless represent equivalents thereto.

The invention claimed is:

1. An apparatus comprising:

a first simulated jewelry chain section formed of an imprint onto a sheet of metal producing a rigid structure;

an actual chain section coupled to the first simulated jewelry chain section; and a second simulated jewelry chain section coupled to the actual chain section formed of an imprint onto a sheet of metal producing a rigid structure, wherein the first and second simulated chain sections are coupled to the actual chain section such that the apparatus appears to be constructed entirely of actual chain.

2. The apparatus of claim 1 wherein the first and second simulated chain sections are coupled to the actual chain section such that a transition from the actual chain to the simulated chain appears substantially identical to a connection of links of the actual chain section.

3. The apparatus of claim 1 wherein the first and second simulated chain sections are each formed from a single piece of material.

4. The apparatus of claim 1 wherein the first and second simulated chain sections are each formed from an upper piece and a lower piece.

5. The apparatus of claim 4 wherein the upper piece and the lower piece are formed to be joined longitudinally to simulate the actual chain, and wherein the lower piece is substantially flat.

6. The apparatus of claim 4 wherein the upper piece and the lower piece are formed to be joined longitudinally to simulate the actual chain, and wherein the upper piece and the lower piece are substantially identical to each other.

7. The apparatus of claim 1 wherein the actual chain section includes at least one chain link.

8. The apparatus of claim 1 wherein the actual chain section is flexible.

9. An apparatus comprising:

a plurality of simulated chain sections formed of an imprint onto a sheet of metal producing a single rigid structure; and a plurality of actual chain sections linking the simulated chain sections to form an article of jewelry that appears to be a homogenous set of chain links connected together.

10. The apparatus of claim 9 wherein the simulated chain sections are coupled to the actual chain sections such that the apparatus appears to be constructed entirely of actual chain.

11. The apparatus of claim 9 wherein the simulated chain sections are coupled to the actual chain sections such that transitions from the actual chains to the simulated chains appear substantially identical to a connection of links of the actual chain sections.

12. The apparatus of claim 9 wherein the simulated chain sections are each formed from a single piece of material.

13. The apparatus of claim 9 wherein the simulated chain sections are each formed from an upper piece and a lower piece.

14. The apparatus of claim 13 wherein the upper piece and the lower piece are formed to be joined longitudinally to simulate the actual chain, and wherein the lower piece is substantially flat.

15. The apparatus of claim 13 wherein the upper piece and the lower piece are formed to be joined longitudinally to simulate the actual chain, and wherein the upper piece and the lower piece are substantially identical to each other.

16. The apparatus of claim 9 wherein the actual chain sections each include at least one chain link.

17. The apparatus of claim 9 wherein the actual chain sections are flexible.

18. An apparatus comprising:

a plurality of substantially rigid simulated flexible jewelry elements formed of imprints onto a sheet of metal; and at least one actual flexible jewelry element linking the simulated flexible jewelry elements to form an article of jewelry that appears to be a homogenous set of actual flexible jewelry elements connected together.

19. The apparatus of claim 18 wherein the simulated flexible jewelry elements are each formed from two or fewer pieces of material.

20. A method comprising:

forming a plurality of substantially rigid simulated flexible jewelry elements, each simulated flexible jewelry element being substantially rigid and formed of an imprint onto a sheet of metal; and linking each of the simulated flexible jewelry elements together using at least one actual flexible jewelry element to form an article of jewelry that appears to be a homogenous set of actual flexible jewelry elements connected together.

21. The method of claim 20 wherein forming includes forming a pattern in a sheet of malleable material.

22. The method of claim 21 wherein forming farther includes joining two or more pieces cut from the patterned sheet.

* * * * *